US007371086B2

(12) United States Patent
Yamada et al.

(10) Patent No.: US 7,371,086 B2
(45) Date of Patent: May 13, 2008

(54) ANTI-UNPLUGGING UNIT AND TRANSMISSION CORD

(75) Inventors: Akifumi Yamada, Tokyo (JP); Shinji Sakamoto, Tokai (JP); Keiji Kawauchi, Komaki (JP); Kazunao Narita, Kasugai (JP)

(73) Assignee: Tomei Tsusin Kogyo Co., Ltd., Inazawa-shi (JP)

( * ) Notice: Subject to any disclaimer, the term of this patent is extended or adjusted under 35 U.S.C. 154(b) by 0 days.

(21) Appl. No.: 11/466,209

(22) Filed: Aug. 22, 2006

(65) Prior Publication Data

US 2007/0049076 A1 Mar. 1, 2007

(30) Foreign Application Priority Data

Aug. 25, 2005 (JP) ..... 2005-244443

(51) Int. Cl.
*H01R 13/44* (2006.01)

(52) U.S. Cl. ..... 439/133; 439/352; 439/502

(58) Field of Classification Search ..... 439/133, 439/352–355, 502–505
See application file for complete search history.

(56) References Cited

U.S. PATENT DOCUMENTS 4,460,234 A * 7/1984 Bogese ..... 439/557
4,946,401 A * 8/1990 Hori et al. ..... 439/224
5,190,465 A * 3/1993 Davidge et al. ..... 439/304
7,025,636 B2 * 4/2006 Allen ..... 439/638

* cited by examiner

*Primary Examiner*—Truc Nguyen
(74) *Attorney, Agent, or Firm*—Hahn & Voight PLLC

(57) ABSTRACT

The invention provides an anti-unplugging unit attached to a plug of a transmission cord and to be put in a jack of electronic or communications equipment with the plug for preventing unauthorized removal of the plug from the jack. The anti-unplugging unit includes a latch member having an engaging portion for engaging a predetermined portion of a jack when the unit with the plug is inserted into the jack, lock means for selectively allowing or preventing release of engagement of the engaging portion with the predetermined portion of the jack, and a housing fixable to the plug and accommodating the latch member and the lock means. The invention also provides a transmission cord including a first cord having plugs at both ends, and the anti-unplugging unit fixed to at least one of the plugs.

7 Claims, 12 Drawing Sheets

(a)

(b)

ANTI-UNPLUGGING UNIT AND TRANSMISSION CORD

FIELD OF ART

The present invention relates to an anti-unplugging unit and a transmission cord for preventing unauthorized access to electronic or communications equipment through a plug of a transmission cord pulled out of a jack of the equipment, or through the jack from which the plug has been removed.

BACKGROUND ART

Electronic or communications equipment, such as computers and servers, has a plurality of jacks, in which plugs of transmission cords are inserted. This enables transmission of data or signals between the equipment and terminals, peripheral equipment, or the like. A plug of a transmission cord is usually insertable into and detachable from the jack relatively easily. If an ill-willed person removes the plug and connects his own portable terminal to the jack, or put the removed plug in a jack of his portable terminal, he may obtain an unauthorized access to the electronic or communications equipment relatively easily, and steal or destroy the information in the equipment.

In order to prevent such an unauthorized access to electronic or communications equipment, countermeasures have been taken, such as restricting physical access to a certain area around the equipment, or placing the whole equipment in a housing and locking the door of the housing.

However, it is often inconvenient to restrict physical access to the area where the electronic or communications equipment is installed, depending on the works of the persons who use the equipment. Even if the physical access to the installation area is restricted, it is difficult to preclude a possibility that an ill-willed person would remove the plug by any means and make unauthorized use of the plug or the jack.

When the whole equipment is placed in a housing, prompt rewiring of the plugs of transmission cords required at times for system modifications or the like, may be disturbed, and for equipment of certain structures, it may even be impossible to provide the housing with a door.

SUMMARY OF THE INVENTION

It is therefore an object of the present invention to provide an anti-unplugging unit and a transmission cord for preventing easy removal of a plug of a transmission cord that has been placed in a jack of electronic or communications equipment.

According to the present invention, there is provided an anti-unplugging unit attachable to a plug of a transmission cord and to be put in a jack of electronic or communications equipment with the plug for preventing unauthorized removal of the plug from the jack, said unit comprising:

- a latch member having an engaging portion for engaging a predetermined portion of a jack when the unit with the plug is inserted into the jack,
- lock means for selectively allowing or preventing release of engagement of the engaging portion with the predetermined portion of the jack, and
- a housing fixable to the plug and accommodating said latch member and said lock means.

The latch member is arranged in the housing with its engaging portion extending out of the housing for insertion into the jack, but most of the latch member is substantially accommodated in the housing.

For facilitating understanding of the invention, the structures of conventional plug and jack are briefly explained. A conventional jack has an opening with a stepped contour formed in a faceplate, and a predetermined portion of the stepped contour acts as a catching portion, which the plug engages. A conventional plus has a body containing built-in terminals, and a tab provided on the body and having flanges for engaging the catching portions of the jack.

In contrast to this, the anti-unplugging unit according to the present invention is to be applied to a plug that has no tab with the flanges to engage the catching portions of the jack. However, the present unit may also be applied to a conventional plug if the tab with the flanges is cut away.

When a plug equipped with the anti-unplugging unit is put in a jack, the engaging portion of the latch member engages the catching portion of the jack defined by the opening with the stepped contour, and the engaging portion is selectively allowed or prevented by the lock means to be released from this engagement, so that removal of the plug from the jack may be prevented. Thus, for example, even when electronic or communications equipment is placed in an area exposed to general public, or far from the hub, removal of a plug from a jack, and connection of the removed plug or jack to a portable terminal of an ill-willed person, are not allowed, and unauthorized access to the equipment is prevented.

In the anti-unplugging unit according to the present invention, an elastic member may also be accommodated in the housing for elastically urging the latch member into engagement with the predetermined portion of the jack at its engaging portion placed in the jack. The lock means may be formed to include a latching engaging member engaging the latch member and actuated for pressing the latch member against the elastic force of the elastic member, and a lock body to be operated with a key for actuating the latch engaging member.

The latch engaging member may be a shaft having a tip with a generally semicircular cross section, and engage the latch member with the tip being placed in a hole formed in the latch member. A vertical position of the engaging portion of the latch member urged by the elastic member is controlled by rotatably actuating the shaft to press a wall of the hole with a circumferential surface of the tip, to thereby press the latch member downwards for releasing engagement of the engaging portion with the jack.

According to the present invention, there is also provided a transmission cord comprising:

- a first cord having plugs at both ends, and
- the above mentioned anti-unplugging unit fixed to at least one of the plugs.

In the transmission cord according to the present invention, the plug having the anti-unplugging unit fixed thereto has no tab to detachably engage a jack. There are two types of plugs for a transmission cord; one is manufactured with the intention to attach the anti-unplugging unit thereto, and the other is a conventional plug. The former has no tab to detachably engage a jack, and the latter has such a tab. The above mentioned transmission cord is based on the former.

The housing of the anti-unplugging unit and the plug may have corresponding engaging means so that the housing is fixed to the plug by means of the engaging means.

In the transmission cord of the present invention, each of the plugs may originally have a tab to detachably engage a jack, and the tab of at least one of the plugs has been removed. The housing of the anti-unplugging unit may include a housing body and a plug cover member, and the housing body and the plug cover member may have corresponding engaging portions. The anti-unplugging unit may be fixed to the plug without the tab by holding the plug and the cord between the housing body and the plug cover member and engaging the corresponding engaging portions of the housing body and the plug cover member. The transmission cord of this embodiment may be produced using a conventional plug.

The transmission cord of the present invention may further include a second transmission cord having plugs at both ends of a cord without the anti-unplugging unit, and the first cord has the anti-unplugging unit fixed to one of its plugs. The first and second cords may be connected to each other at the plugs without the anti-unplugging unit via a jack unit, and the jack unit and the plugs connected thereto may be sealed in a closure casing.

In this embodiment, either a conventional jack unit or a jack unit having tab restriction means inside may be used. The tab restriction means may be formed inside the jack unit and engage the tab of the plug placed in the jack unit to substantially prevent the tab from being pressed down. When the jack unit with the tab restriction means is used, a closure casing may be dispensed with.

With the present invention, removal of a plug of a transmission cord disposed in a jack of electronic or communications equipment, which allows unauthorized access to the equipment through the removed plug or jack, may be prevented.

BRIEF DESCRIPTION OF THE DRAWINGS

FIG. 4(*b*) is a sectional view taken at a right angle to FIG. 4(*a*); and FIG. 4(*c*) is a rear view of the anti-unplugging unit; wherein the latch member is in its uppermost position.

FIG. 5(*b*) is a sectional view taken at a right angle to FIG. 5(*a*); and FIG. 5(*c*) is a rear view of the anti-unplugging unit; wherein the latch member is in its lowermost position.

FIG. 6(*b*) is a side view of; and

FIG. 6(*c*) is a front view thereof.

FIG. 7(*b*) is a rear view thereof; and

FIG. 7(*c*) is a side view of the plug cover member.

FIG. 10(*c*) is a front view of a jack.

PREFERRED EMBODIMENTS OF THE INVENTION

The present invention will now be explained in more detail with reference to the attached drawings, which are illustrative only and do not intend to limit the present invention.

Figure 1:
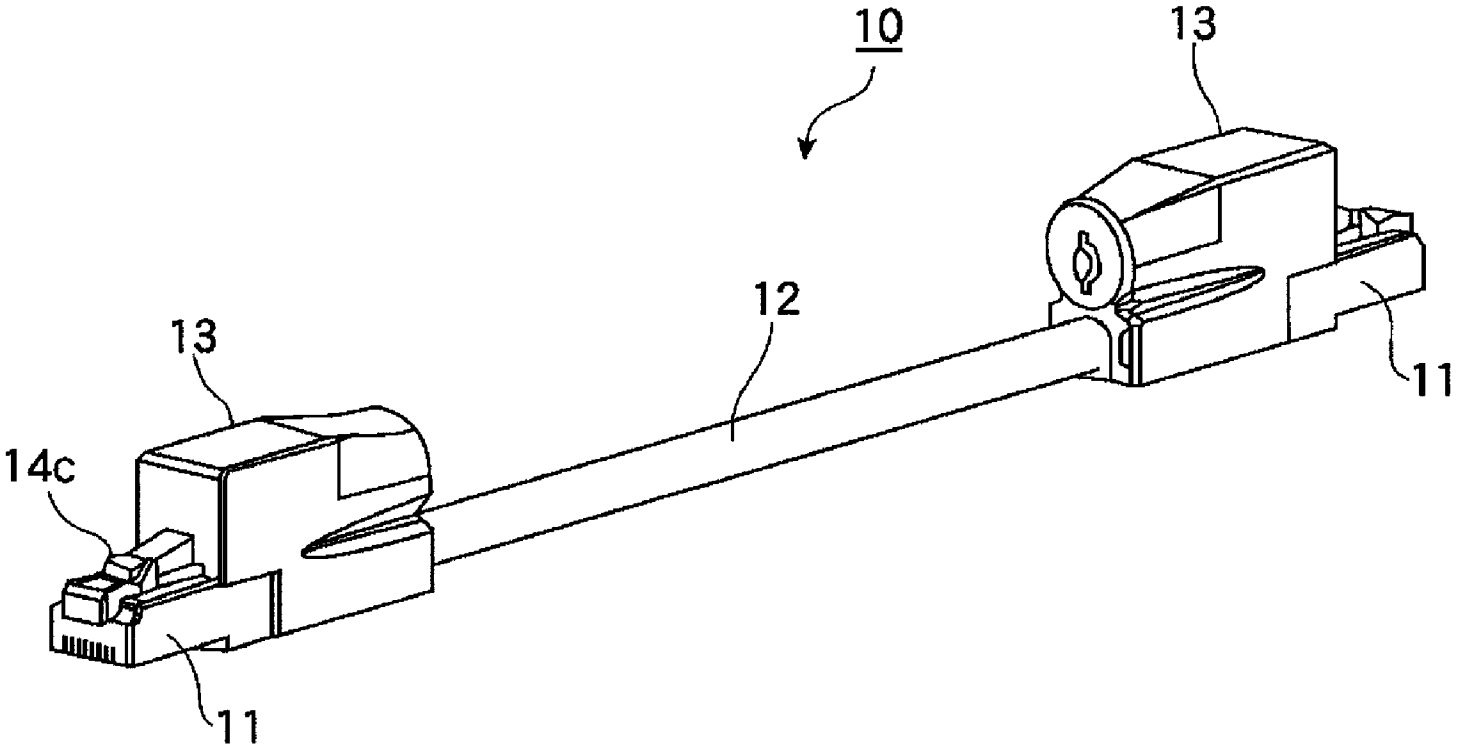
FIG. 1 is a perspective view of the transmission cord according to the present invention.
Figure 2:
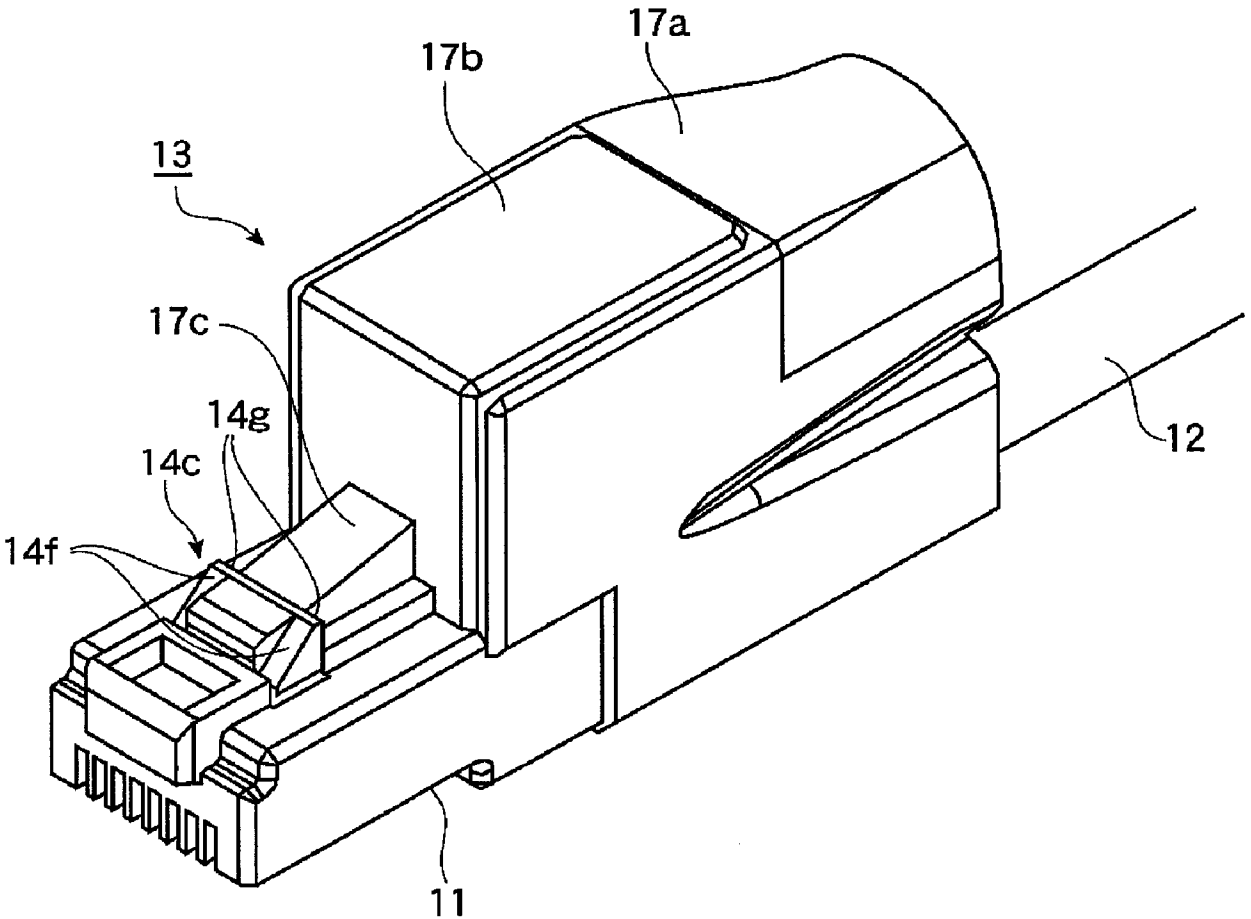
FIG. 2 is an enlarged perspective view of one end of the transmission cord according to the present invention.
Figure 3:
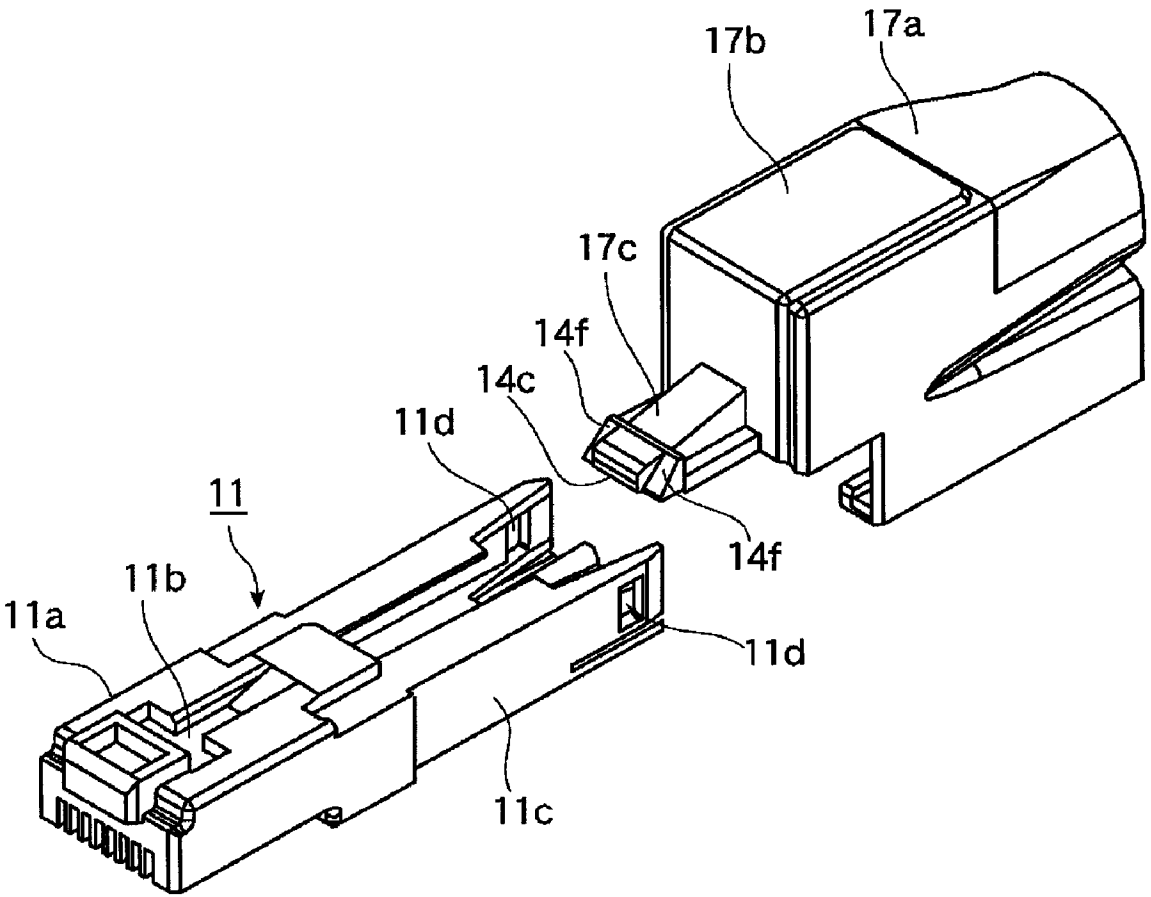
FIG. 3 is a perspective view of the anti-unplugging unit according to the present invention and a plug.

FIG. 1 is a perspective view of transmission cord 10 according to the present invention, and FIG. 2 is an enlarged perspective view of one end of the transmission cord 10. The transmission cord 10 has plugs 11 as shown in FIG. 3 provided at both ends of cord 12, and anti-unplugging unit 13 attached to each plug 11, so that the plug 11 is prevented from being pulled out of a jack of electronic or communications equipment without authorization.

As an alternative to the embodiment shown in FIG. 1, the transmission cord may also be formed by providing only at one end of the cord 12 the plug 11, to which the anti-unplugging unit 13 is attached, and at the other end a conventional plug 11, to which no anti-unplugging unit 13 is attached.

Figure 10:
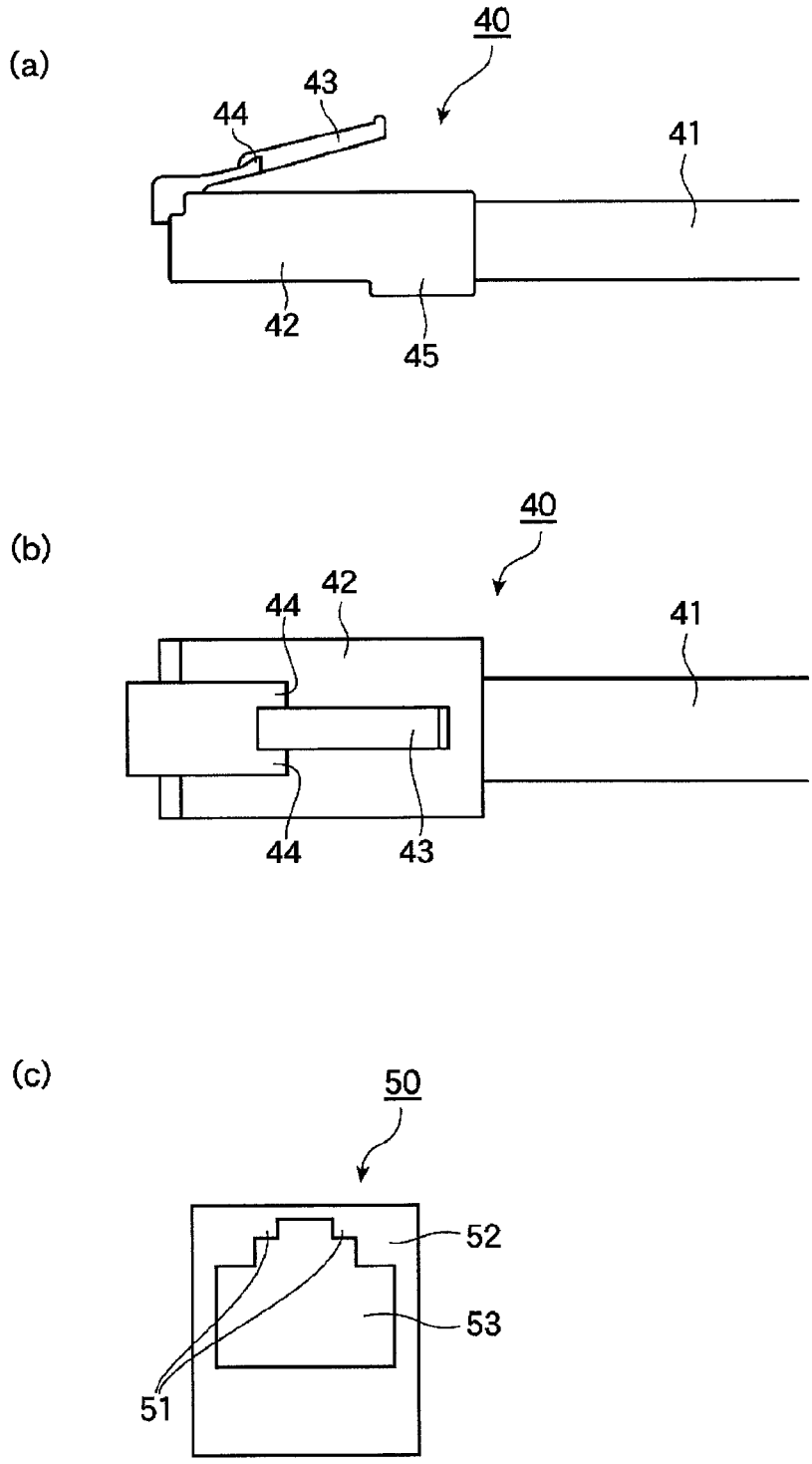
FIGS. 10(*a*) and 10(*b*) are side and plan views, respectively, of a conventional plug.

For comparison with the plug 11 to be used in the transmission cord 10, conventional plug 40 and jack 50 are briefly described with reference to FIG. 10. As shown in FIGS. 10(*a*) and 10(*b*), conventional plug 40 has body 42 connected to cord 41, and tab 43 integrated with the body 42. The tab 43 is provided with flanges 44 for engagement with catching portions 51 of jack 50. The body 42 has step 45 on the side opposite to the tab 43.

A jack of electronic or communications equipment into which a plug of a transmission cord is put, i.e., jack 50 into which the plug 40 is put, is in the form of opening 53 with a stepped contour, formed in faceplate 52 as shown in FIG. 10(*c*). The portions of the faceplate 52 defined by the stepped contour act as catching portions 51, which the flanges 44 of the plug 40 engage.

In contrast to the conventional plug 40 as discussed above, the plug 11 used in the present invention, as shown in FIG. 3, has no elements corresponding to the tab 43 and the flanges 44. The plug 11 has body 11*a*, which is provided with groove 11*b* in its upper surface, and insert 11*c* in its rear part for inserting into the anti-unplugging unit 13. The insert 11*c* has engagement apertures 11*d* in both side faces.

Figure 4:
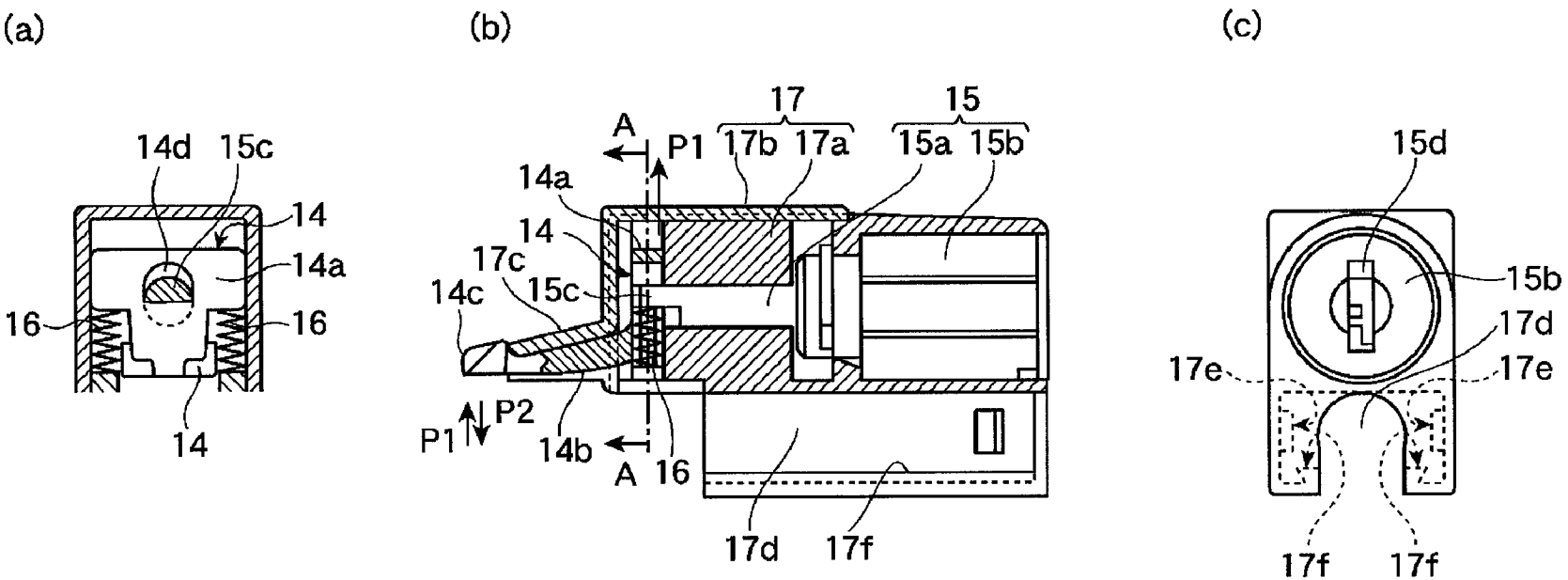
FIG. 4(*a*) is a cross sectional view of the present anti-unplugging unit taken along lines A-A in FIG. 4(*b*)
Figure 5:
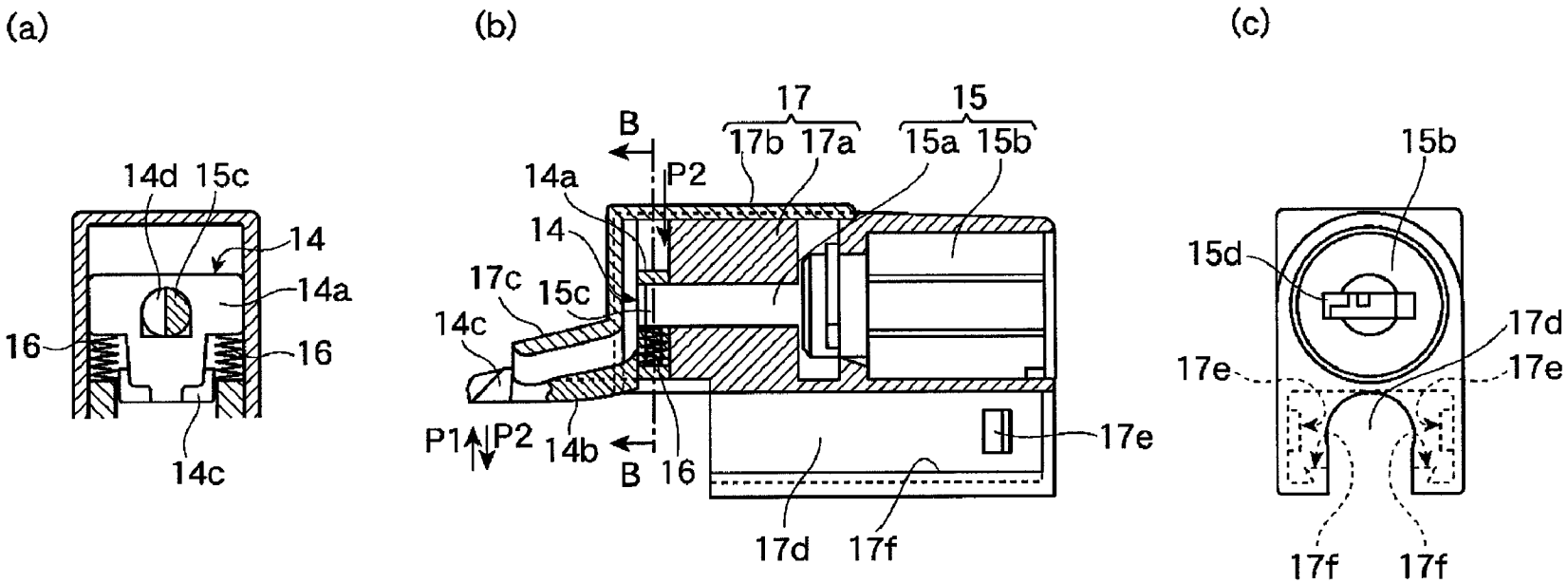
FIG. 5(*a*) is a cross sectional view of the anti-unplugging unit of FIG. 4 taken along lines B-B in FIG 5(*a*)

As shown in FIGS. 4 and 5, the anti-unplugging unit 13 has latch member 14, lock means 15, and springs 16, all placed in housing 17. The latch member is urged upwards by the springs 16 in the direction of arrow P1. The lock means 15 includes latch engaging member 15*a* and lock body 15*b*, and controls the position of the latch member 14 in the directions of arrows P1 and P2.

FIG. 4 shows the latch member 14 urged in the direction of arrow P1 into its uppermost position, whereas FIG. 5 shows the latch member 14 pressed in the direction of arrow P2 into its lowermost position.

Next, the structure of the anti-unplugging unit 13 is explained in detail.

Figure 6:
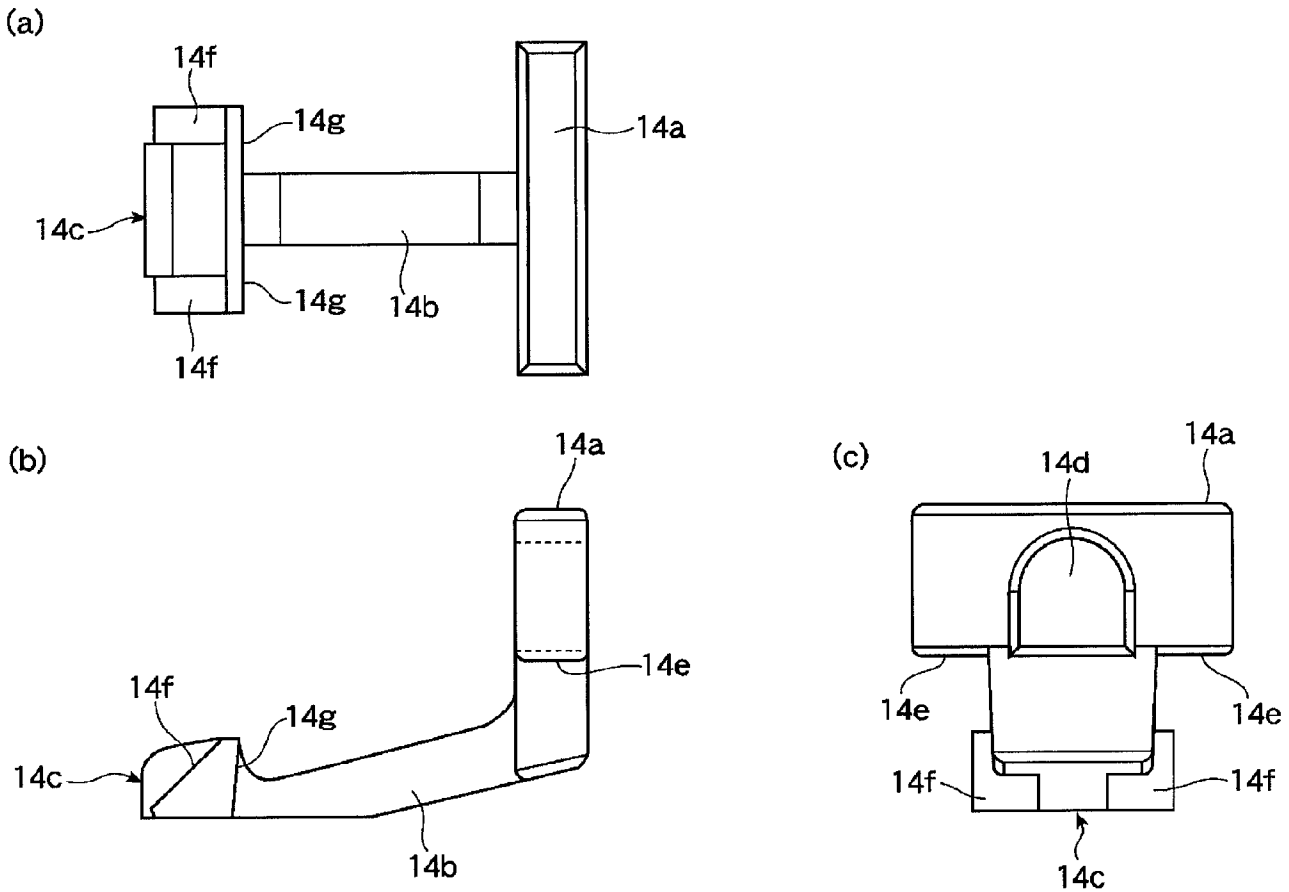
FIG. 6(*a*) is a plan view of the latch member.

FIGS. 6(*a*) to 6(*c*) are plan, side, and front views, respectively, of the latch member 14.

The latch member 14 has slide portion 14*a*, which slides within the housing 17, and arm portion 14*b* extending from the side portion 14*a* and having engaging portion 14*c* on its tip. The engaging portion 14*c* is projected out of the housing 17.

The slide portion 14*a* has through hole 14*d* having an elongated semicircular section generally in the middle thereof, and spring seats 14*e* in the lower surface thereof on both sides of the through hold 14*d*. The spring seats 14*e* are arranged above the springs 16, and receive the force of the springs 16 so that the slide portion 14*a* is urged in the direction of arrow P1. The through hole 14*d* receives tip 15*c* of the latch engaging member 15*a* inserted therein. As shown in FIG. 4(*a*), since the through hole 14*d* is larger than the cross section of the tip 15*c* of the latch engaging member 15*a*, and the slide portion 14*a* is urged upwards under the elastic force of the springs 16 in the direction of arrow P1, there is kept a clearance above the tip 15*c* in the through hole 14*d*. Thus when a downward force is applied on the engaging portion 14*c* in the direction of arrow P2, the slide portion 14*a* may be pressed down in the direction of arrow P2 with this clearance, without any operation of the latch engaging member 15*a*.

The engaging portion 14*c* has slants 14*f* and stop surfaces 14*g*. When the anti-unplugging unit 13 with the plug 11 is inserted into the jack 50, the slants 14*f* slide in contact with the catching portions 51 of the jack 50. In this process, the engaging portions 14*c* is pressed downwards by the catching portions 51, whereby the slide portion 14*a* is pressed in the direction of arrow P2 against the force of the springs 16. When the plug 11 with the anti-unplugging unit 13 is placed in the jack 50, the stop surfaces 14*g* engage behind the catching portions 51 of the jack 50, and the slide portion 14*a* is urged upwards under the elastic force of the springs 16, so that the engaging portion 14*c* is not pressed down in the direction of arrow P2 even if a pulling force is applied.

The lock means 15 includes lock body 15*b* and latch engaging member 15*a*. The lock body 15 may be a conventional cylinder lock unit, and is operated by means of a key (not shown) inserted into key hole 15*d* in the rear surface thereof to rotatably actuate the latch engaging member 15*a*.

The latch engaging member 15*a* is a columnar shaft member and has tip 15*c* with a generally semicircular cross section. The tip 15*c* is inserted into the through hold 14*d* of the latch member 14, and contacts the wall of the through hole 14*d* to control the position of the engaging portion 14*c* of the latch member 14 in the directions of arrow P1 and P2. That is, when the flat diametrical surface of the tip 15*c* is in contact with the flat wall of the through hole 14*d* as shown in FIG. 4(*a*), the engaging portion 14*c* is in its uppermost position. From this position, when the latch engaging member 15*a* is rotated, the curved circumferential surface of the tip 15*c* contacts the flat wall of the through hole 14*d* to gradually press the latch member 14 downwards. When the latch engaging member 15*a* is rotated for about 90 degrees, the engaging portion 14*c* is pressed down for the maximum distance, i.e. the engaging portion 14*c* takes its lowermost position to release the engagement between the engaging portion 14*c* and the catching portions 51 of the jack 50.

As shown in FIGS. 4 and 5, the housing 17 includes housing body 17*a* having a cavity for accommodating the latch member 14 and the lock means 15, and latch cover 17*b* fit over the housing body 17*a* to cover the latch member 14 placed in the housing body 17*a*. The latch body 17*b* has arm cover 17*c* protruding therefrom for covering the arm portion 14*b* of the latch member 14, while the engaging portion 14*c* extends out of the arm body 17*c*.

The housing body 17*a* has plug receiving section 17*d*, into which the plug 11 is inserted. The plug receiving section 17*d* has opposing side walls, and on the inner surface of each side wall in its rear part, engagement projection 17*e* is formed for fitting in the engagement aperture 11*d* of the plug 11. Along the lower edge of each side wall of the plug receiving section 17*d*, insertion guide rail 17*f* extends for fitting in an inserting guide groove (not shown) provided in the insert 11*c* of the plug 11.

When the plug 11 is inserted into the plug receiving section 17*d* having the above structure, the engagement projections 17*e* fit in the engagement apertures 11*d* to fix and integrate the plug 11 and the anti-unplugging unit 13 as shown in FIGS. 1 and 2.

In inserting the plug 11 integrated with the anti-unplugging unit 13 into the jack 50, the slants 14*f* of the engaging portion 14*c* slide in contact with the catching portions 51 of the jack 50, and the slide portion 14*a* of the latch member 14 is pressed in the direction of arrow P2 against the force of the springs 16. Thus without operating the latch engaging member 15*a* with the key, the plus 11 may be inserted into the jack 50. When the plug 11 is placed in the jack 50, the stop surfaces 14*g* engage the catching portions 51 of the jack 50, so that the plug 11 is hard to be pulled out of the jack 50. In the anti-unplugging unit 13 placed in the jack 50, the latch member 14 is in its uppermost position in the direction of arrow P1, as shown in FIG. 4.

For pulling the plug 11 integrated with the anti-unplugging unit 13 out of the jack 50, the key is inserted into the key hold 15*d* in the lock body 15*b* and turned to rotatably actuate the latch engaging member 15*a*. By rotating the latch engaging member 15*a*, the circumferential surface of the tip 15*c* rotates on the flat wall of the through hole 14*d* in the slide portion 14*a* while it presses the slide portion 14*a* in the direction of arrow P2. When the latch engaging member 15*a* is rotated for about 90 degrees, the engagement between the engaging portion 14*c* and the catching portions 51 of the jack 50 is released, and the plug 11 with the anti-unplugging unit 13 may be detached by pulling with fingers. Here, in the anti-unplugging unit 13, the latch member 14 is in its lowermost position in the direction of arrow P2, as shown in FIG. 5.

As discussed above, one the plug 11 integrated with the anti-unplugging unit 13 is placed in the jack 50, the plug 11 cannot be pulled out of the jack 50 without operating the lock member 15 with the key inserted into the key hole 15*d*. Thus the plug 11 cannot be removed from the jack 50 by an ill-willed person or the like without authorization, so that unauthorized access to the electronic or communications equipment by connecting the plug 11 or the jack 50 to a portable terminal of the ill-willed or the like is prevented.

Figure 7:
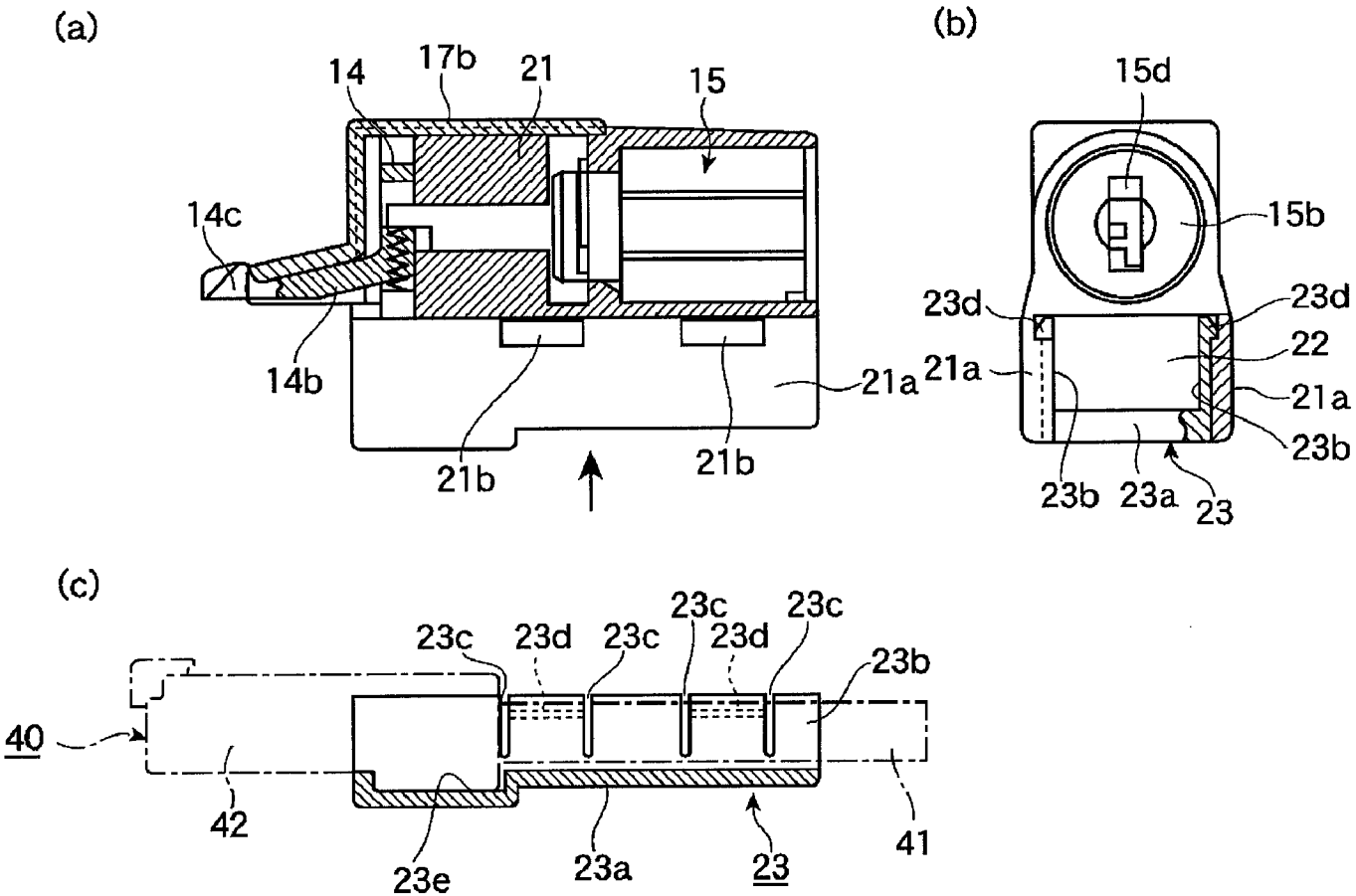
FIG. 7(*a*) is a sectional view of another embodiment of the anti-unplugging unit different from FIG. 3.

Next, another embodiment of the anti-unplugging unit, which is applicable to a conventional plug 40 (see FIG. 10) is discussed with reference to FIG. 7 showing the unit in sectional and rear views.

The anti-unplugging unit 20 is different from the anti-unplugging unit 13 of the previous embodiment shown in FIGS. 1 to 5 in plug receiving section 22 of the housing body 21, but the rest of the unit 20 is generally the same as in the unit 13. Thus the same elements are referred to by the same reference numerals as in the previous embodiment, and will not be explained further.

The plug receiving section 22 includes a pair of opposing side walls 21*a* integrally formed with the housing body 21, and plug cover member 23 fit between the side walls 21*a*.

In the inner surface of each side wall 21*a*, engagement dent 21*b* is formed.

The plug cover member 23 has bottom plate 23*a* and two side plates 23*b* erecting from the sides of the bottom plate 23*a*. Each side plate 23*b* is provided with a plurality of slits 23*c*, which divide the side plate 23*b* into a plurality of sections. In certain locations of these sections, engagement projections 23*d* are formed, which engage engagement dents 21*b* in the housing body 21 to integrate and fix the plug cover member 23 with the housing body 21. In the bottom plate 23*a* of the plug cover member 23, plug fixing recess 23*e* is formed for engagement with the step 45 of the plug 40.

Figure 8:
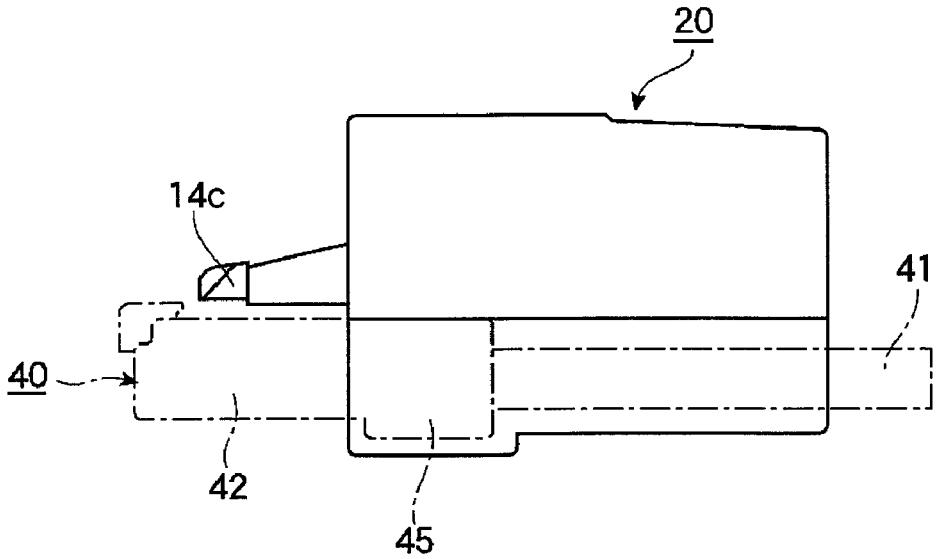
FIG. 8 is a side view of the anti-unplugging unit of FIG. 7.

For fixing the anti-unplugging unit 20 to a conventional plug 40, the tab 43 with the flanges 44 is removed from the plug 40 in advance, and then the plug 40 is positioned in the plug cover member 23 as shown in phantom in FIG. 7(*c*), which is then fit between the side walls 21*a* of the housing body 21. In this way, the anti-unplugging unit 20 is integrally fixed to the plug 40 as shown in FIG. 8.

Figure 9:
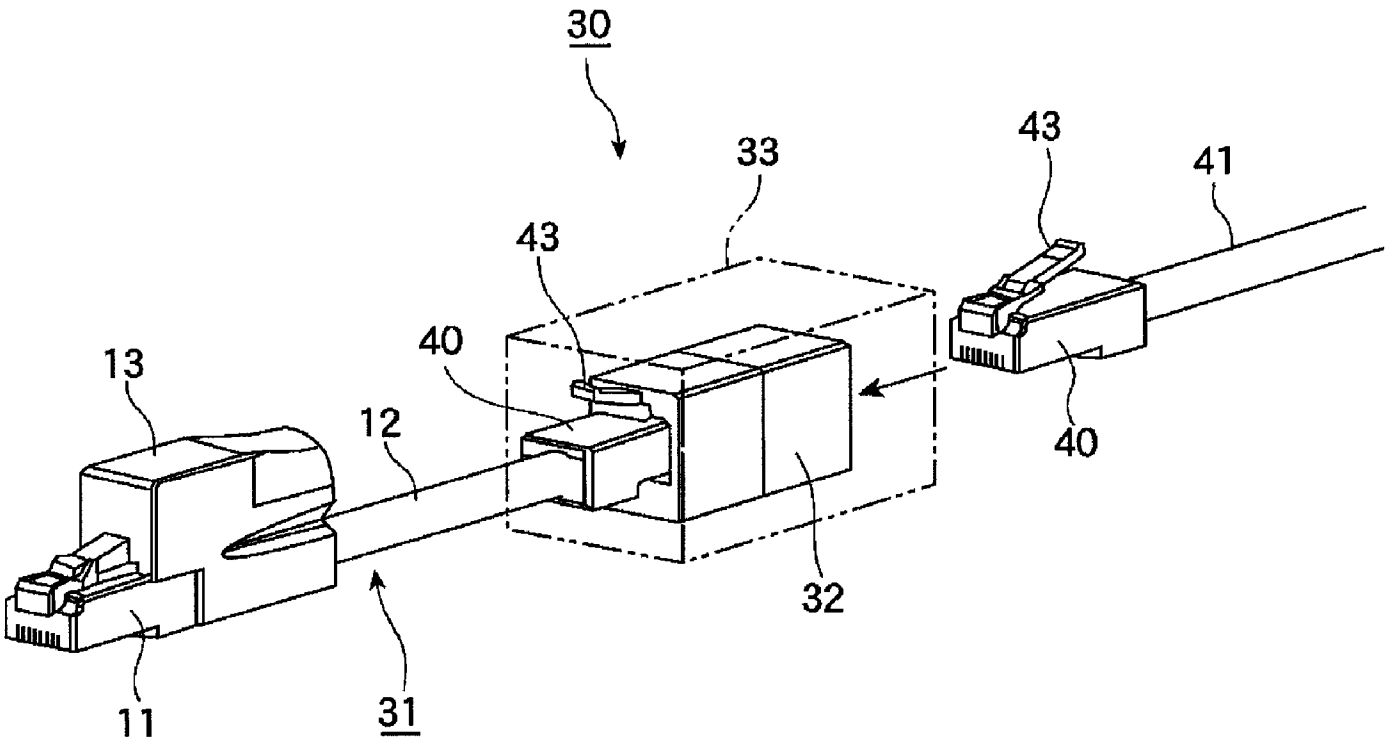
FIG. 9 is a perspective view of another embodiment of the transmission cord different from FIG. 1.

FIG. 9 shows in perspective another embodiment of the transmission cord 30, which is different from the embodiment of FIG. 1.

The transmission cord 30 includes first transmission cord 31 and second transmission cord 41 connected thereto via jack unit 32, which is sealed in closure casing 33.

In the first transmission cord 31, only the plug 11 at one end is provided with the anti-unplugging unit 13, and the plug 40 at the other end is a conventional plug, to which no anti-unplugging unit 13 is attached.

The second transmission cord 41 has conventional plugs 40 at both ends, to which no anti-unplugging unit is attached.

The jack unit 31 is a conventional unit for connecting two plugs 40, and has two opposing jacks formed on both sides and connected via internal wiring.

The closure casing 33 sealingly covers the jack unit 32 to prevent operation of the tab 43 of the plug 40, so that the plug 40 cannot be removed from the jack unit 32.

The transmission cord 30 of this structure may be formed by connecting transmission cord 31 of the present invention to existing, conventional transmission cord 41 already wired to a jack of an electronic or communications equipment at the installation site of the equipment.

A modification of the transmission cord 30 of FIG. 9 is discussed next. In this embodiment, the closure casing 33 in FIG. 9 is not used, and the jack unit 32 of FIG. 9 is replaced with jack unit 35 as shown in FIGS. 11 and 12.

Figure 11:
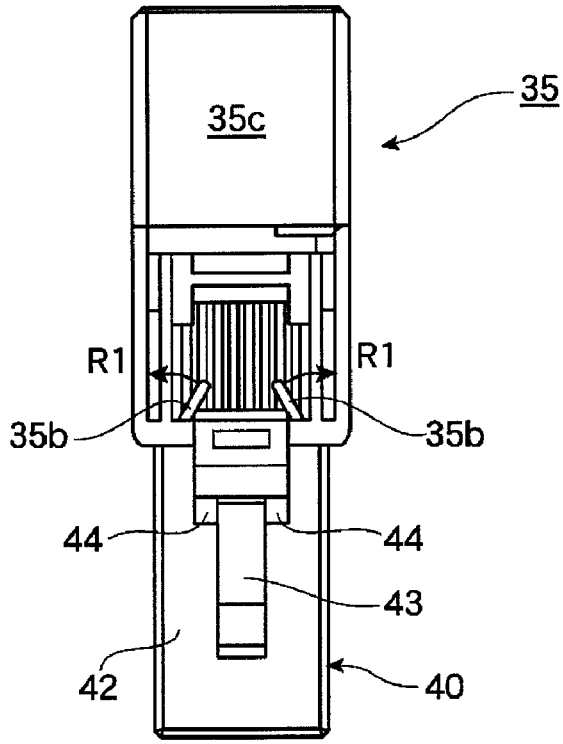
FIGS. 11(*a*) and 11(*b*) are plan and perspective views, respectively, showing insertion of a plug into a jack unit.
Figure 11:
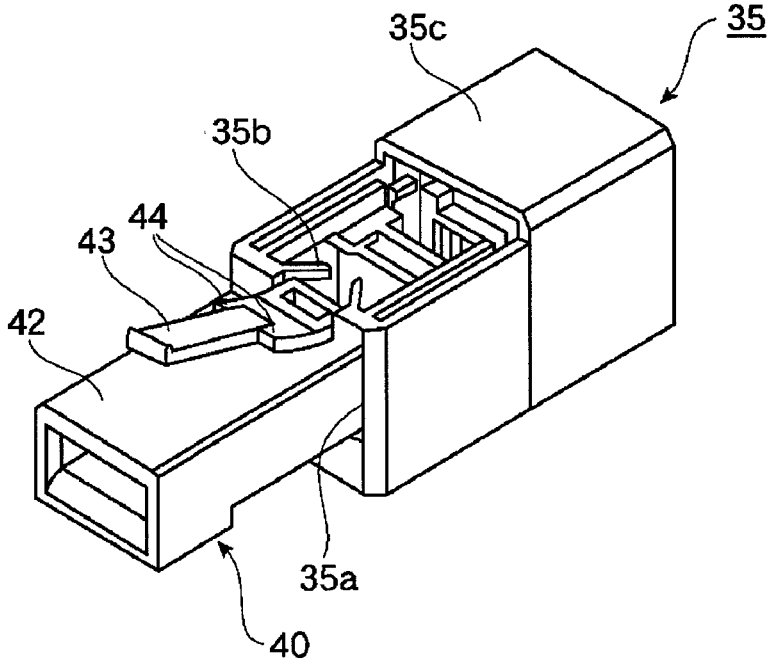
Figure 12:
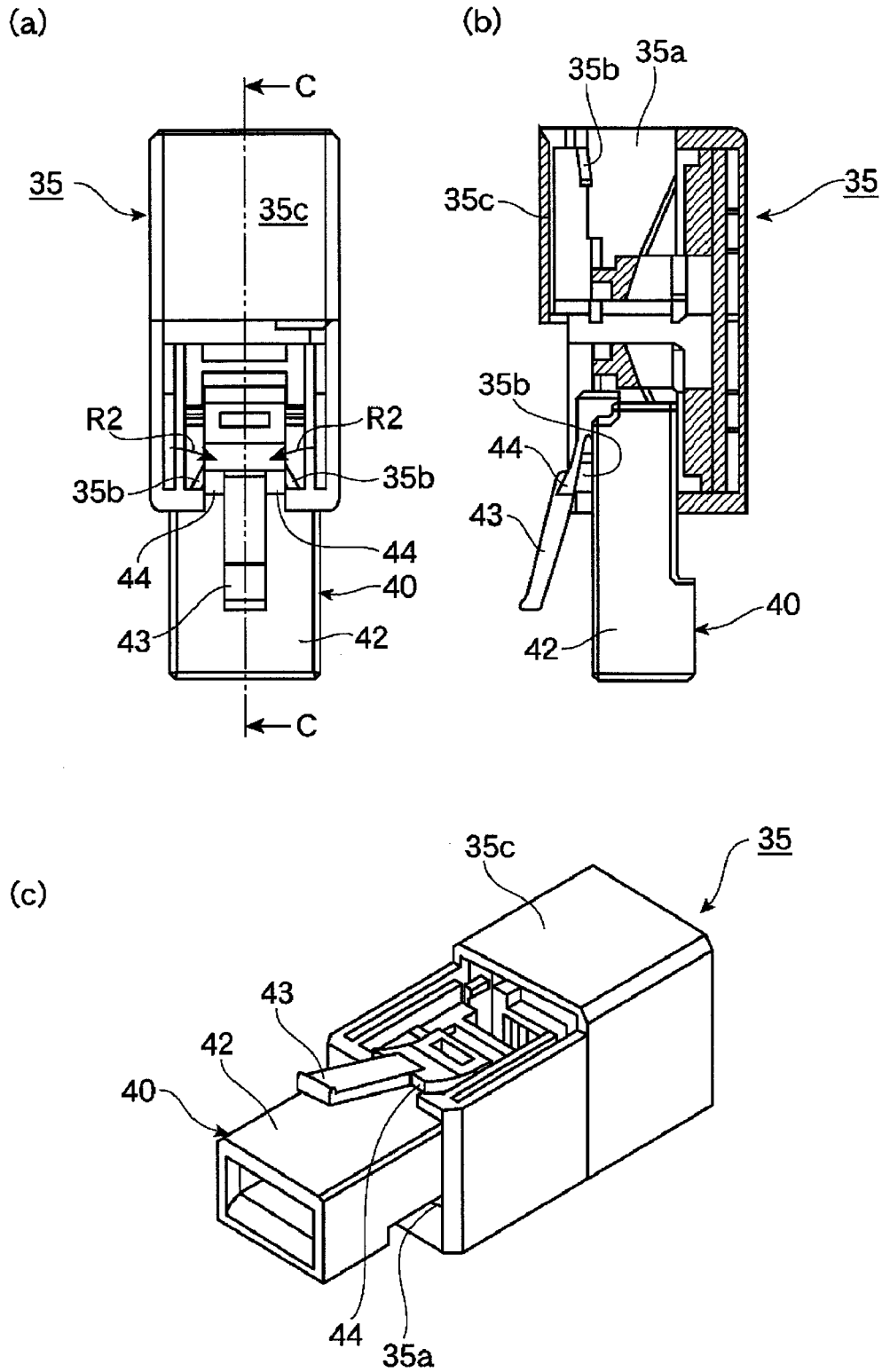
FIGS. 12(*a*) to 12(*c*) are plan, sectional, and perspective views, respectively, of the jack unit with the plug inserted therein.

FIGS. 11(*a*) and 11(*b*) are plan and perspective views, respectively, showing the plug 40 being inserted into the jack unit 35, and FIGS. 12(*a*) to 12(*c*) are plan, sectional, and perspective views, respectively, showing the plug 40 already placed in the jack unit 35.

The jack unit 35 has two opposing openings 35*a* for receiving the plugs therein. In each opening 35*a*, as shown in FIG. 11(*a*), a pair of opposing tab restriction pieces 35*b* is provided so that the gap between the pieces is smaller from the opening 35*a* towards inside. The tab restriction pieces 35*b* are formed to elastically deform in the directions of arrows R1. In FIGS. 11 and 12, a half of the unit 35 designated by 35*c* is not shown in detail for the sake of clarity in explaining the tab restriction pieces 35*b*.

In inserting the plug 40 into the jack unit 35, the flanges 44 of the tab 43 press and elastically deform the tab restriction pieces 35*b* to push open the tips of the tab restriction pieces 35*b* in the directions of arrows R1. When the plug 40 is inserted into the jack unit 35 to a predetermined extent, and the tab 43 returns to its initial position, the flanges 44 of the tab 43 engage the catching portions of the jack unit 35. At the same time, the pair of tab restriction pieces 35*b* also returns in the directions of arrows R2 in FIG. 12(*a*) due to their elasticity, to fit between the flanges 44 and the body 42. With the tab restriction pieces being fit in this position, the tab 43 cannot be pressed down substantially. That is, the tab 43 cannot be pressed down unless the flanges 44 are detached from the catching portions of the jack unit 35, so that unauthorized removal of the plug 40 from the jack unit 32 is prevented.

Once the tab restriction pieces 35*b* are fit between the flanges 44 and the body 42, even if the tab restriction pieces 35*b* are tried to be pushed between with a pin or the like for unauthorized removal of the plug, the pin per se disturbs the tab 43 to be pressed down. This also assists in preventing unauthorized removal of the plug 40 from the jack unit 35.

What is claimed is:

1. An anti-unplugging unit attachable to a plug of a transmission cord and to be put in a jack of electronic or communications equipment with the plug for preventing unauthorized removal of the plug from the jack, said unit comprising:

a latch member having an engaging portion for engaging a predetermined portion of a jack when the unit with the plug is inserted into the jack, lock means for selectively allowing or preventing release of engagement of the engaging portion with the predetermined portion of the jack, and a housing fixable to the plug and accommodating said latch member, said lock means, and an elastic member for elastically urging the latch member into engagement with the predetermined portion of the jack at its engaging portion placed in the jack, and wherein said lock means comprises a latch engaging member engaging the latch member and actuated for pressing said latch member against the elastic force of said elastic member, and a lock body to be operated with a key for actuating the latch engaging member.

2. The anti-unplugging unit according to claim 1, wherein said latch engaging member comprises a shaft having a tip with a generally semicircular cross section, wherein said latch engaging member engages the latch member with said tip being placed in a hole formed in the latch member, wherein a vertical position of the engaging portion of the latch member urged by the elastic member is controlled by rotatably actuating said shaft to press a wall of said hole with a circumferential surface of the tip, to thereby press the latch member downwards for releasing engagement of the engaging portion with the jack.

3. A transmission cord comprising:

a first cord having plugs at both ends, and an anti-unplugging unit fixed to at least one of said plugs, wherein said anti-unplugging unit comprises:

a latch member having an engaging portion for engaging a predetermined portion of a jack when the unit with the plug is inserted into the jack, lock means for selectively allowing or preventing release of engagement of the engaging portion with the predetermined portion of the jack, and a housing fixable to the plug and accommodating said latch member, said lock means, and an elastic member for elastically urging the latch member into engagement with the predetermined portion of the jack at its engaging portion placed in the jack, and wherein said lock means comprises a latch engaging member engaging the latch member and actuated for pressing said latch member against the elastic force of said elastic member, and a lock body to be operated with a key for actuating the latch engaging member.

4. The transmission cord according to claim 3, wherein said plug having the anti-unplugging unit fixed thereto has no tab to detachably engage a jack, and wherein said housing of the anti-unplugging unit and the plug have corresponding engaging means so that the housing is fixed to the plug by means of said engaging means.

5. The transmission cord according to claim 3, wherein each of said plugs originally has a tab to detachably engage a jack, and the tab of at least one of said plugs has been removed, and wherein said housing of the anti-unplugging unit comprises a housing body and a plug cover member, said housing body and said plug cover member having corresponding engaging portions, wherein said anti-unplugging unit is fixed to said plug without the tab by holding the plug and the cord between the housing body and the plug cover member and engaging the corresponding engaging portions of the housing body and the plug cover member.

6. The transmission cord according to claim 3, further comprising a second transmission cord having plugs at both ends of a cord without the anti-unplugging unit, wherein said first cord has the anti-unplugging unit fixed to one of its plugs, wherein said first and second cords are connected to each other at the plugs without the anti-unplugging unit via a jack unit, and wherein said jack unit and the plugs connected thereto are sealed in a closure casing.

7. The transmission cord according to claim 3, further comprising a second transmission cord having plugs at both ends of a cord without the anti-unplugging unit, wherein said first cord has the anti-unplugging unit fixed to one of its plugs, wherein said first and second cords are connected to each other via a jack unit at the plugs without the anti-unplugging unit, and wherein said jack unit has tab restriction means for engaging the tab of the plug placed in the jack unit to substantially prevent the tab from being pressed down.

* * * * *